US006456250B1

(12) United States Patent
Ying et al.

(10) Patent No.: US 6,456,250 B1
(45) Date of Patent: Sep. 24, 2002

(54) MULTI FREQUENCY-BAND ANTENNA

(75) Inventors: Zhinong Ying, Lund; Anders Dahlström, Vellinge, both of (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 0 days.

(21) Appl. No.: 09/861,526

(22) Filed: May 22, 2001

Related U.S. Application Data

(60) Provisional application No. 60/246,749, filed on Nov. 9, 2000.

(30) Foreign Application Priority Data

May 23, 2000 (DK) ..... 2000 00820
Nov. 1, 2000 (EP) ..... 00610112

(51) Int. Cl.[7] ..... H01Q 1/38; H01Q 1/24
(52) U.S. Cl. ..... 343/702; 343/702; 343/850
(58) Field of Search ..... 343/700 MS, 702, 343/850, 851, 852, 795, 895; 455/89, 90

(56) References Cited

U.S. PATENT DOCUMENTS 6,061,024 A * 5/2000 McGirr et al. ..... 343/700 MS
6,166,694 A * 12/2000 Ying ..... 343/700 MS
6,295,030 B1 * 9/2001 Kozakai et al. ..... 343/700 MS
6,339,402 B1 * 1/2002 McKivergan ..... 343/700 MS
6,343,208 B1 * 1/2002 Ying ..... 343/702

* cited by examiner

*Primary Examiner*—Tan Ho
(74) *Attorney, Agent, or Firm*—Burns, Doane, Swecker & Mathis, L.L.P.

(57) ABSTRACT

A multi frequency band antenna with a low band portion (LB) tuned to a low frequency band, and a first high band portion (HB1) tuned to a first high frequency band at higher frequencies than the low frequency band. The low band portion (LB) and the first high band portion (HB1) have a common first grounding point (GP1), a common feeding point (FP) for feeding input signals to the antenna and for outputting signals from the antenna, and a first conductor portion (CP1), which forms part of the low band portion (LB) and of the first high band portion (HB1). The first conductor portion (CP1) is electrically connected to the first grounding point (GP1) and to the common feeding point (FP), A second high band portion (HB2) is coupled to the first conductor portion (CP1) and tuned to a second high frequency band at a higher frequency than the low frequency band and different from the first high frequency band. The antenna can be tuned to eg the frequencies 900 MHz, 1800 MHz and 1900 MHz currently used for mobile telephones.

14 Claims, 2 Drawing Sheets

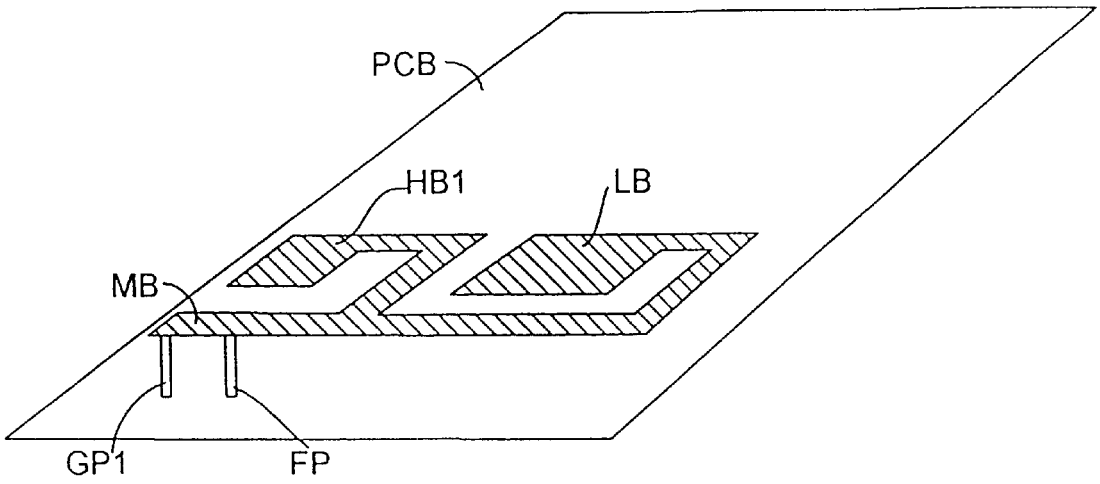
Fig. 1 - prior art
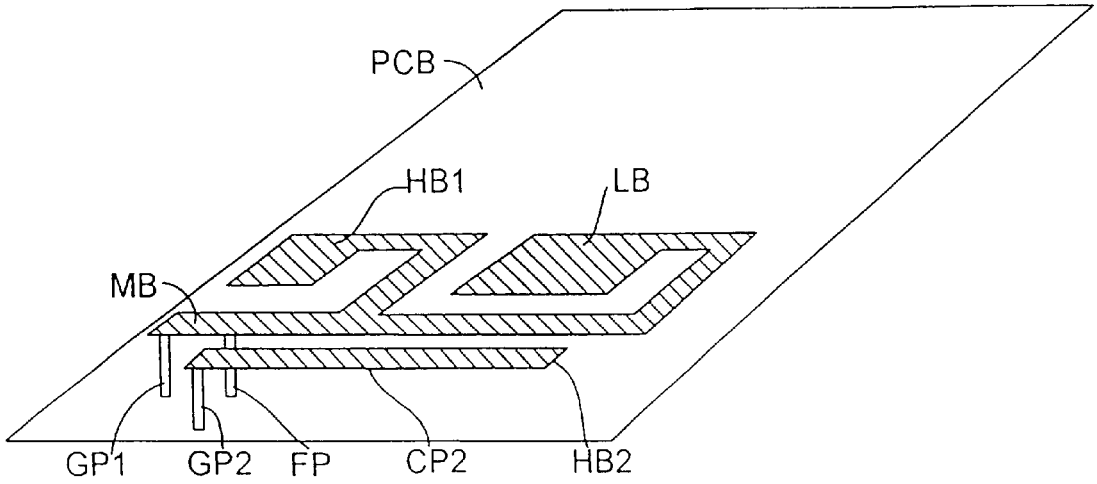
Fig. 2
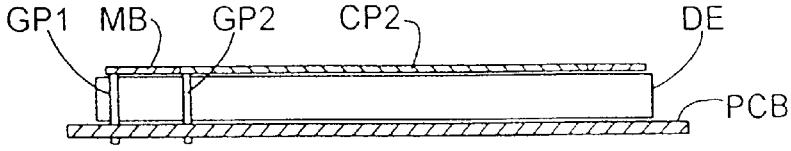
Fig. 3

MULTI FREQUENCY-BAND ANTENNA

This application claims benefit of Provisional Application 60/246,749 filed Nov. 9, 2000.

FIELD OF THE INVENTION

The invention relates to antennas for use in portable communications devices such as mobile telephones. Portable communications devices are required to be compact in size, which is a requirement that applies to every component of the devices, including the antenna. Modern mobile telephones use two or more distinct frequency bands, and preferably one and the same antenna is required to operate in all frequency bands used by the telephone.

RELATED PRIOR ART

Currently, most mobile telephones use one or more of the following three frequency bands: the GSM band centred on the frequency 900 MHz, the DSC band centred on 1800 MHz, and the PCS band centred on 1900 MHz. The 900 MHz and 1800 MHz frequency bands are separated by one octave, whereas the 1800 MHz and 1900 MHz frequency bands are separated by only a fraction of one octave. In many mobile telephones using the 900 MHz and 1800 MHz frequency bands the antenna has separate portions tuned to respective ones of the two frequency bands, since it is not considered feasible to have one and the same portion of the antenna tuned to a frequency band of more than one octave with a relatively large unused frequency band between the useful frequency bands.

On the other hand, the two U.S. patent applications Ser. Nos. 09/112152 and 09/212259 describe attempts having been made to have one and the same portion of the antenna cover both high frequency bands centred on 1800 MHz and 1900 MHz with a lower frequency limit of 1710 MHz and an upper frequency limit of 1990 MHz—a bandwidth of 280 MHz. The improvement in bandwidth is obtained at the expense of antenna gain.

It is the object of the invention to provide an antenna, which is usable in at least three frequency bands and which has a minimum loss, ie maximum gain in all frequency bands.

SUMMARY OF THE INVENTION

The invention provides an antenna for use in eg portable communications devices such as mobile telephones. The antenna is useful in a low frequency band and two high frequency bands, where the two high frequency bands are relatively closer to each other than to the low frequency band. The antenna is thus effectively a triple band antenna, and a mobile telephone having such an antenna is thus useful in three frequency bands such as the above identified three frequency bands centred on 900 MHz, 1800 MHz and 1900 MHz respectively. However, the invention is not restricted to the use in the above-identified frequency bands, but will be suitable for use in existing and future frequency bands as well.

BRIEF DESCRIPTION OF THE DRAWINGS

FIG. 1 schematically shows a known dual band antenna electrically connected to a printed circuit board, FIG. 2 schematically shows a preferred embodiment of a triple band antenna of the invention electrically connected to a printed circuit board, FIG. 3 is an end view of the antenna and printed circuit board of FIG. 2, FIG. 4 schematically shows the printed circuit board with the antenna in FIG. 2.

DETAILED DESCRIPTION OF THE INVENTION

Figure 4:
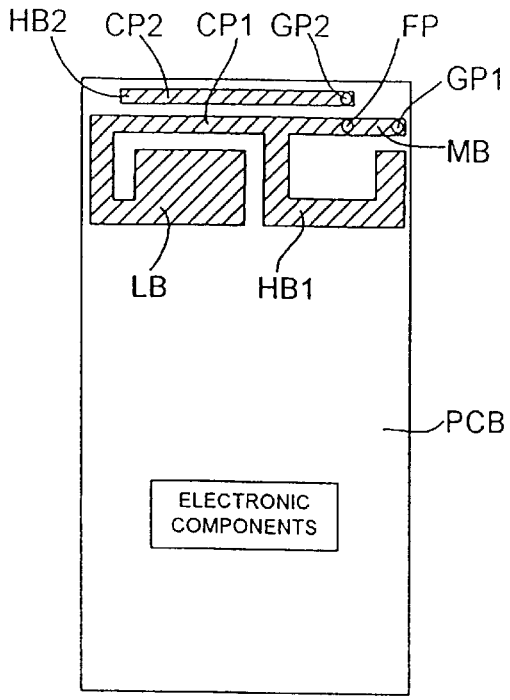

In FIGS. 2–4, a printed circuit board PCB with an antenna according to the invention for use in a mobile telephone is shown. In the shown embodiment, for illustrative purposes, the printed circuit board has a rectangular shape, and the invention is not restricted to the use of a rectangular shape. In practical use the printed circuit board will have a number of electronic components mounted thereon, which are necessary for the operation of the mobile telephone, but which are not part of the invention. In FIG. 4 such components are therefore indicated only schematically.

In FIGS. 2–4 an electrically conductive material, such as copper, constitutes the antenna of the invention. The antenna is preferably spaced from the printed circuit board PCB with a predetermined distance therebetween. A first conductor portion CP1, which is rectilinear in this embodiment, has a grounding point with a first grounding post GP1 at a first end of the first conductor portion CP1. In use the grounding point will be electrically connected through the first grounding post GP1 to ground potential at the printed circuit board PCB. Near the first end and at a predefined distance therefrom, the first conductor portion CP1 has a feeding point with a feeding post FP electrically connecting the first conductor portion CP1 to an electronic circuit on the PCB for feeding the antenna with signals to be transmitted by the antenna, and/or to electronic circuitry for receiving signals received by the antenna. The portion of the first conductor portion CP1 situated between the feeding post FP and the first grounding post GP1 functions as a matching bridge MB.

At a second end, opposite the first end, a low band portion LB branches off at one side of the straight first conductor portion CP1 and forms a spiral. Here, three rectilinear segments forming right angles with each other constitute the low band spiral. The innermost segment in the spiral is wider than the remaining three rectilinear segments including the conductor portion CP1.

Between the first and second ends a first high band portion HB1, also forming a spiral, branches off at a right angle and at the same side as the low band portion LB. The first high band spiral is also constituted by three rectilinear segments forming right angles with each other. The segments constituting the first high band spiral have substantially equal widths.

The low band portion LB of the antenna is tuned to have a relatively low resonance frequency, such as 900 MHz, and a predefined bandwidth to define a low frequency band of the antenna. The low resonance frequency is mainly determined or influenced by the length of the low band portion LB measured from the feeding point FP to the inner end of the spiral, which length corresponds to one quarter of a wavelength at the low resonance frequency. When an electrical signal with frequencies in the low frequency band is fed to the feeding point FP of the antenna, corresponding electromagnetic signals will be radiated from the low band portion LB of the antenna as radio waves; and, vice versa, when the antenna receives electromagnetic signals in the form of radio waves with frequencies in the low frequency band, electrical signals will be generated by the low band portion LB of the antenna, and the thus generated electrical signals are sensed at the feeding post FP by receiving electronic circuitry connected to the antenna.

The first high band portion HB1 of the antenna is tuned to have a first high resonance frequency, such as 1800 MHz, and predefined bandwidth to define a first high frequency band. The first high resonance frequency is mainly determined or influenced by the length of the first high band portion HB1 measured from the feeding point FP to the inner end of the spiral, which length corresponds to one quarter of a wavelength at the first high resonance frequency. When an electrical signal with frequencies in the first high frequency band is fed to the feeding point FP of the antenna, corresponding electromagnetic signals will be radiated from the first high band portion HB1 of the antenna as radio waves, and, vice versa, when the antenna receives electromagnetic signals in the form of radio waves with frequencies in the first high frequency band, electrical signals will be generated by the first high band portion HB1 of the antenna, and the thus generated electrical signals are also sensed at the feeding point FP by receiving electronic circuitry connected to the antenna.

Together, the low band portion LB and the first high band portion HB1 of the antenna form a dual band antenna which is usable in mobile telephones operating in two frequency bands such as 900 MHz and 1800 MHz.

So far the antenna of the invention corresponds to the known antenna shown in FIG. 1.

In accordance with the invention the antenna also has a second high band portion HB2 in the form of a second conductor portion CP2 arranged in a parallel relationship to the first conductor portion CP1 and at a predetermined distance therefrom. At a first end the second high band portion HB2 has a grounding point electrically connected through a second grounding post GP2 to ground potential on the PCB. The second grounding post GP2 is arranged in close vicinity of the feeding post FP, preferably at a distance of 0.5 mm, or at least in the range between 0.1 mm and 1.0 mm.

Together the first conductor portion CP1 and the second conductor portion CP2 form an electrical capacitor. A capacitive or parasitic coupling therefore exists between the first conductor portion CP1 and the second conductor portion CP2. The second high band portion HB2 of the antenna is tuned to have a second high resonance frequency, such as 1900 MHz, and predefined bandwidth to define a second high frequency band. The second high resonance frequency is mainly determined or influenced by the length of the second conductor portion CP2, which corresponds to one quarter of a wavelength at the second high frequency, and the capacitive coupling between the first conductor portion CP1 and the second conductor portion CP2.

In the alternative, the first high band portion HB1 of the antenna can be tuned to the higher one of the two high band resonance frequencies—here 1900 MHz, and the second high band portion HB2 of the antenna can be tuned to the lower one of the two high band resonance frequencies—here 1800 MHz.

When an electrical signal with frequencies in the second high frequency band is fed to the feeding post FP of the antenna, these signals will be coupled to the second conductor portion CP2, due to the tuning of the capacitive or parasitic coupling existing between the first conductor portion CP1 and the second conductor portion CP2, and corresponding electromagnetic signals will be radiated from the second high band portion HB2 of the antenna as radio waves. When the antenna receives electromagnetic signals in the form of radio waves with frequencies in the second high frequency band, electrical signals will, vice versa, be generated by the second high band portion HB2 of the antenna, and these signals will be coupled to the first conductor portion CP1, and the thus generated electrical signals are also sensed at the feeding post FP by receiving electronic circuitry connected to the antenna.

The first high band portion HB1 of the antenna is arranged on one side of the first linear conductor portion CP1, and the second high band portion HB2 of the antenna is arranged on the opposite side of first linear conductor portion CP1. Hereby interference between the two high frequency bands is reduced to a minimum.

In FIG. 3 it is seen most clearly that the active portions of the antenna (including the linear conductor portions CP1 and CP2, the low and high band portions LB, HB1 and HB2) are spaced from the printed circuit board PCB. In the space between the active portions of the antenna and the PCB there is a dielectric substrate DE with physical dimensions and specific dielectric properties selected for the proper functioning of the antenna. The thickness of the dielectric substrate DE is not necessarily the same as the distance separating the active portions of the antenna from the printed circuit board PCB.

When used in a mobile telephone, the active portions of the antenna may be placed close to the inner side of a housing wall of the telephone or even fixed or secured thereto, eg by gluing. In such case the dielectric properties of the housing material and their influence on the functioning of the antenna should be taken into account.

Figure 5:
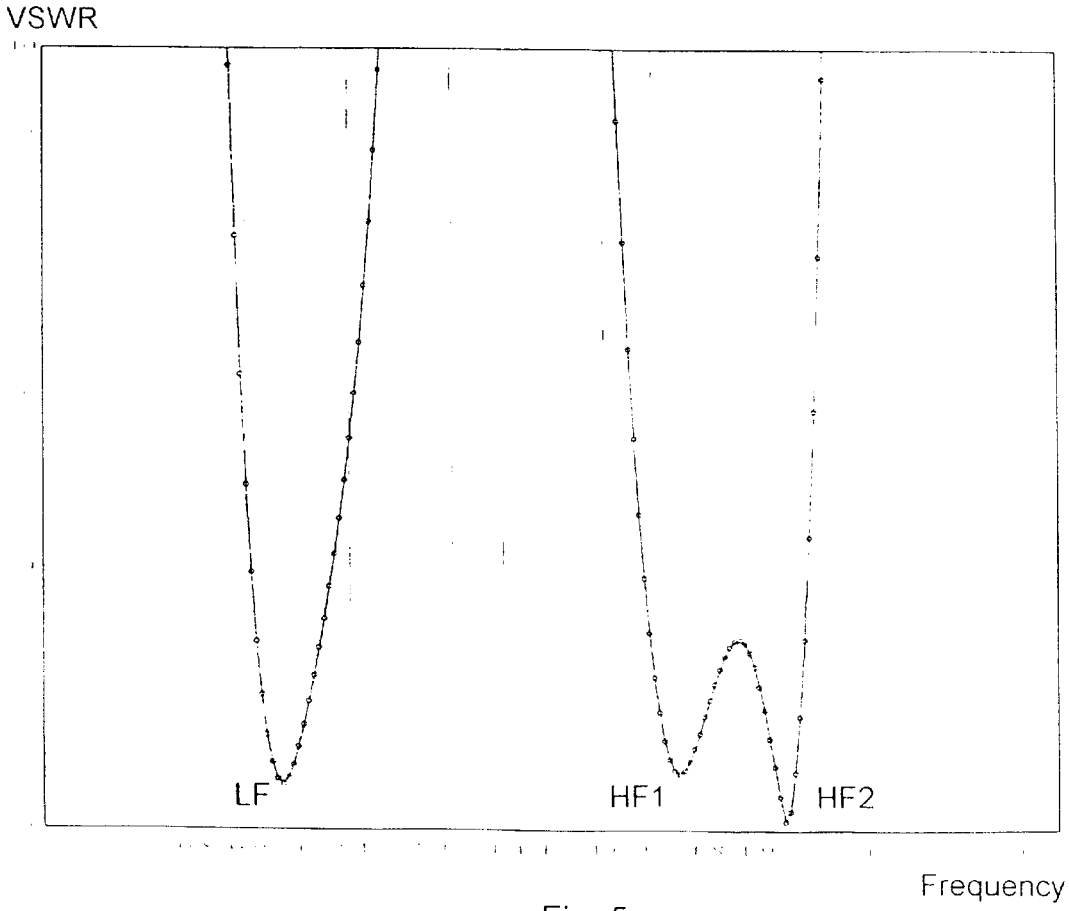
FIG. 5 is a diagram showing a typical return loss for an antenna according to the invention.

In FIG. 5 is shown a typical return loss for a multi frequency band antenna according to the invention. The return loss is here expressed as the voltage standing. wave ratio (VSWR) of the antenna drawn on a linear frequency scale from 500 MHz to 2.5 GHz. The return loss has one distinct minimum at a low frequency band and two minima at two high frequency bands HF1 and HF2 relatively close to each other.

What is claimed is:

1. A multi frequency band antenna comprising a low band portion tuned to a low frequency band, and a first high band portion tuned to a first high frequency band at higher frequencies than the low frequency band, where the low band portion and the first high band portion have a common first grounding point, a common feeding point for feeding input signals to the antenna and for outputting signals from the antenna, and a first conductor portion forming part of the low band portion and of the first high band portion, the first conductor portion being electrically connected to the first grounding point and to the common feeding point, characterized in that a second high band portion is coupled to the first conductor portion and tuned to a second high frequency band at a higher frequency than the low-frequency band and different from the first high frequency band.

2. An antenna according to claim 1, characterized in that the second high band portion includes a second conductor portion capacitively coupled to the first conductor portion.

3. An antenna according to claim 1, wherein each of first conductor portion and the second conductor portion includes substantially linear portion.

4. An antenna according to claim 3, characterized in that the second conductor portion is arranged substantially parallel to the first conductor portion.

5. An antenna according to claim 4, characterized in that the second conductor portion is arranged substantially parallel to the first conductor portion over a length corresponding to one quarter of a wavelength of a frequency in the second high frequency band.

6. An antenna according to claim 1, characterized in that each of the low band portion and the first high band portion is configured substantially in a spiral form and each branches off from the substantially linear first conductor portion at a first side of the first conductor portion.

7. An antenna according to claim 6 characterized in that the second high band portion is arranged at a second side opposite the first side of the first conductor portion.

8. An antenna according to claim 6, characterized in that each of the low band portion and the first high band portion spirals includes substantially linear portions of conductive material.

9. An antenna according to claim 8, characterized in that the substantially linear portions of conductive material are arranged in pairs forming substantially right angles.

10. An antenna according to claim 1, wherein a carrier with predetermined dielectric properties supports the antenna.

11. An antenna according to claim 1, wherein the second high band portion (HB2) has a second grounding point arranged in close vicinity of the feeding point of the antenna.

12. An antenna according to claim 11, characterized in that the grounding point of the second high band portion is arranged at a distance between 0.1 mm and 1.0 mm from the feeding point of the antenna.

13. An antenna according to claim 11, characterized in that the grounding point of the second high band portion is arranged at substantially 0.5 mm distance from the feeding point of the antenna.

14. A mobile communications unit having an antenna according to claim 1.

* * * * *